US009424719B2

(12) United States Patent
Biggar et al.

(10) Patent No.: US 9,424,719 B2
(45) Date of Patent: Aug. 23, 2016

(54) GAMING SYSTEM AND METHOD FOR SUDOKU-BASED GAME

(75) Inventors: William B. Biggar, Kansas City, MO (US); James Kenneth Blundell, Kansas City, MO (US)

(73) Assignee: SUDOKUPDQ(TM) LLC, Topeka, KS (US)

( * ) Notice: Subject to any disclaimer, the term of this patent is extended or adjusted under 35 U.S.C. 154(b) by 559 days.

(21) Appl. No.: 12/557,227

(22) Filed: Sep. 10, 2009

(65) Prior Publication Data

US 2010/0093444 A1 Apr. 15, 2010

Related U.S. Application Data

(60) Provisional application No. 61/095,679, filed on Sep. 10, 2008.

(51) Int. Cl.
*A63F 3/04* (2006.01)
*G07F 17/32* (2006.01)

(52) U.S. Cl.
CPC ..... *G07F 17/3295* (2013.01); *A63F 2003/0418* (2013.01)

(58) Field of Classification Search
CPC ..... A63F 17/3295; A63F 2003/0418; G07F 17/3295
USPC ..... 463/10
See application file for complete search history.

(56) References Cited

U.S. PATENT DOCUMENTS

| | | | | |
|---|---|---|---|---|
| 6,964,608 | B1 * | 11/2005 | Koza | 463/9 |
| 8,322,723 | B1 | 12/2012 | Bancel et al. | |
| 2007/0117622 | A1 * | 5/2007 | Walker et al. | 463/29 |
| 2007/0173311 | A1 * | 7/2007 | Morrow et al. | 463/16 |
| 2008/0254893 | A1 * | 10/2008 | Patel et al. | 463/42 |

OTHER PUBLICATIONS

Russell, Ed and Frazer Jarvis, "Mathematics of Sudoku II", Jan. 25, 2006.*
"Sudoku Explainer—FAQ", Nov. 27, 2006.*
"Sudoku Gridmaster", 2006, Nintendo of America, Inc.*
"Sudoku: Bagging a Difficulty Metric & Building Up Puzzles", Feb. 18, 2008.*

* cited by examiner

*Primary Examiner* — Werner Garner
(74) *Attorney, Agent, or Firm* — Husch Blackwell LLP

(57) ABSTRACT

A gaming system and method for administering a Sudoku-based game is provided that includes at least one engine for randomly generating a Sudoku puzzle, at least one first module for modifying the generated Sudoku puzzle into a game puzzle, at least one second module for permuting the game puzzle for each player, and at least one system for providing a game puzzle to each player and administering a gaming game from the game puzzle provided to each player.

14 Claims, 11 Drawing Sheets

GAMING SYSTEM AND METHOD FOR SUDOKU-BASED GAME

CROSS-REFERENCE TO RELATED APPLICATIONS

The present application is a nonprovisional of and claims the benefit of U.S. Provisional Patent Application Ser. No. 61/095,679, filed Sep. 10, 2008, which document is incorporated herein by reference to the extent permitted by law.

BACKGROUND OF THE INVENTION

The Sudoku puzzle was originally designed by Howard Gains, a retired architect and freelance puzzle maker and was first published in 1979. The puzzle was inspired by an eighteenth century invention of a Swiss mathematician Leonard Euler. Euler's Latin Square was a table or grid filled with symbols such that each symbol occurs exactly once in each row and column. Gains presented the Latin Square as a puzzle by providing a partially completed grid which then required the solver to fill in the rest of the numbers. The puzzle was first published in New York by Dell Magazines under the title "Number Place."

The puzzle reappeared in Japan in the paper Monthly Nikolist in April 1984 as Suuji W A Dokushin Ni Kaguru which translates as "the numbers must be single." The name was abbreviated to Sudodu. Within Japan, Nikoli Publishers still hold the trademark for the name Sudoku. In 1989, Loadstar/Softdisk Publishing unveiled a computerized-version of the game for the home computer. Other computer versions for the Apple® and the Palm Pilot® also appeared in the mid-nineties. In 1997, a New Zealander named Wayne Gould began to develop a computer program to produce Sudoku puzzles quickly. He promoted Sudo Ku to the London Times which launched it on Nov. 12, 2004. Since then, Sudoku has appeared in numerous printed versions such as newspapers and puzzle books as well as electronic versions that may be played on personal computers, cell phones, the internet, hand-held units and the like. Also, in 2005, Sky Sports in England introduced Sudoku Live which was a game show that used pencil and paper to solve standard puzzles in a team format. Sudoku has become an international sensation and has been called "the Rubik's cube of the 21$^{st}$ Century."

In a typical Sudoku puzzle, not only numbers, but any set of distinct symbols can be used in the grid. Letters, shapes, colors, and any other collection of nine symbols can be used as the solution set. The objective of the puzzle is to complete a 9×9 grid that consists of nine 3×3 boxes so that each column, row and each box contains the digits 1 through 9 only once. Typical Sudoku terminology describes a grid consisting of 9 boxes each of which contains 9 cells. Variations in grid size have been introduced, although the 9×9 grid is traditional and most common. Variants such as 12×12, 16×16, and 25×25 have appeared in various publications. Sudoku puzzles can be ranked by the degree of difficulty of their solution. Typically, the levels are "easy", "difficult", or "hard". The level of difficulty is driven by the positioning and relationships between the given numbers not necessarily by the quantity of numbers given. The attraction of the puzzle is that the completion rules are simple, yet the reasoning to reach a solution may be difficult. A so-called "well-formed" Sudoku puzzle has one and only one solution.

BRIEF SUMMARY OF THE INVENTION

The disclosed subject matter is a contest of skill and speed held among multiple players sitting at a table, a standalone unit, or a virtual table. Any number of players may be accommodated, but a minimum of five players is particularly preferred for a sufficient award pot. A variety of predetermined parameters may be used to selectively assign players to a particular table including, but not limited to, wager amount per game, wager denomination, player skill level, game difficulty level, rate of play, and the like. For example, physical neighbors might be playing in the same $5.00 game, or one may be playing $1 game against 12 players spread across the casino and his neighbor playing $100/game against similarly spread players that are not at the same physical table. The contest requires skill and speed on behalf of the player, and no element of chance is involved in the outcome of each contest. The system is scalable, and can be played from multiple locations, including off-table and off-casino physical (for example, off-gaming floor, -gaming hall or -casino property) or virtual (for example, internet gaming sites) locations.

Each gaming table has a wagering table and a required entry fee or "ante", which must be paid for each contest and which is uniform for all players at the table. For example, the contestants (players) compete against each other in a game lasting 3 minutes, consisting of five "speed rounds" lasting twenty seconds each. Thus, 20 games of the disclosed game can be played in one hour, every hour. One critical difference between the disclosed game and all other manifestations of Sudoku is that the disclosed game only requires a player to fill in one blank square of the squares designated to be filled in.

The disclosed subject matter is directed to a system for administering a gaming game. The system includes, at least one engine for randomly generating a sudoku puzzle, at least one first module for modifying the generated sudoku puzzle into a game puzzle, and at least one second module for permuting the game puzzle for each player. There is also at least one system for providing a game puzzle to each player and administering a gaming game from the game puzzle provided to each player.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawing forms a part of the specification and is to be read in conjunction therewith, in which like reference numerals are employed to indicate like or similar parts in the various views, and wherein.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is generally directed to Sudoku-based game and a method for playing a Sudoku-based game. It will be appreciated that, however, that the game hereof may be implemented with themes and symbology somewhat different from traditional Sudoku presentations. For example, one embodiment described herein utilizes a traditional 9×9 box grid with the numbers 1-9. However, it will be appreciated that 6×6 grids, 12×12 grids, 16×16 grids, 25×25 grids, hyper-Sudoku grids, or any other suitable format may be used without departing from the scope of the present invention. Moreover, different symbology such as Arabic numerals, Kanji characters or other symbols such as stars, bells or other indicia may be substituted for each of the numbers 1-9 found in traditional Sudoku puzzles without deviating from the scope of the invention. In other aspects of the invention, the game hereof may present different puzzles or a combination of a Sudoku puzzle with another game such as Battleship® or Minesweeper® or the like. For example, the Sudoku puzzle grid may incorporate symbology such as a battleship or a mine that, when filled in with a numeral 1-9, offers a bonus or the like. However, it will be appreciated by one skilled in the art that any variant of or combination with the Sudoku-base game hereof is well with the scope of the present invention.

Figure 1A:
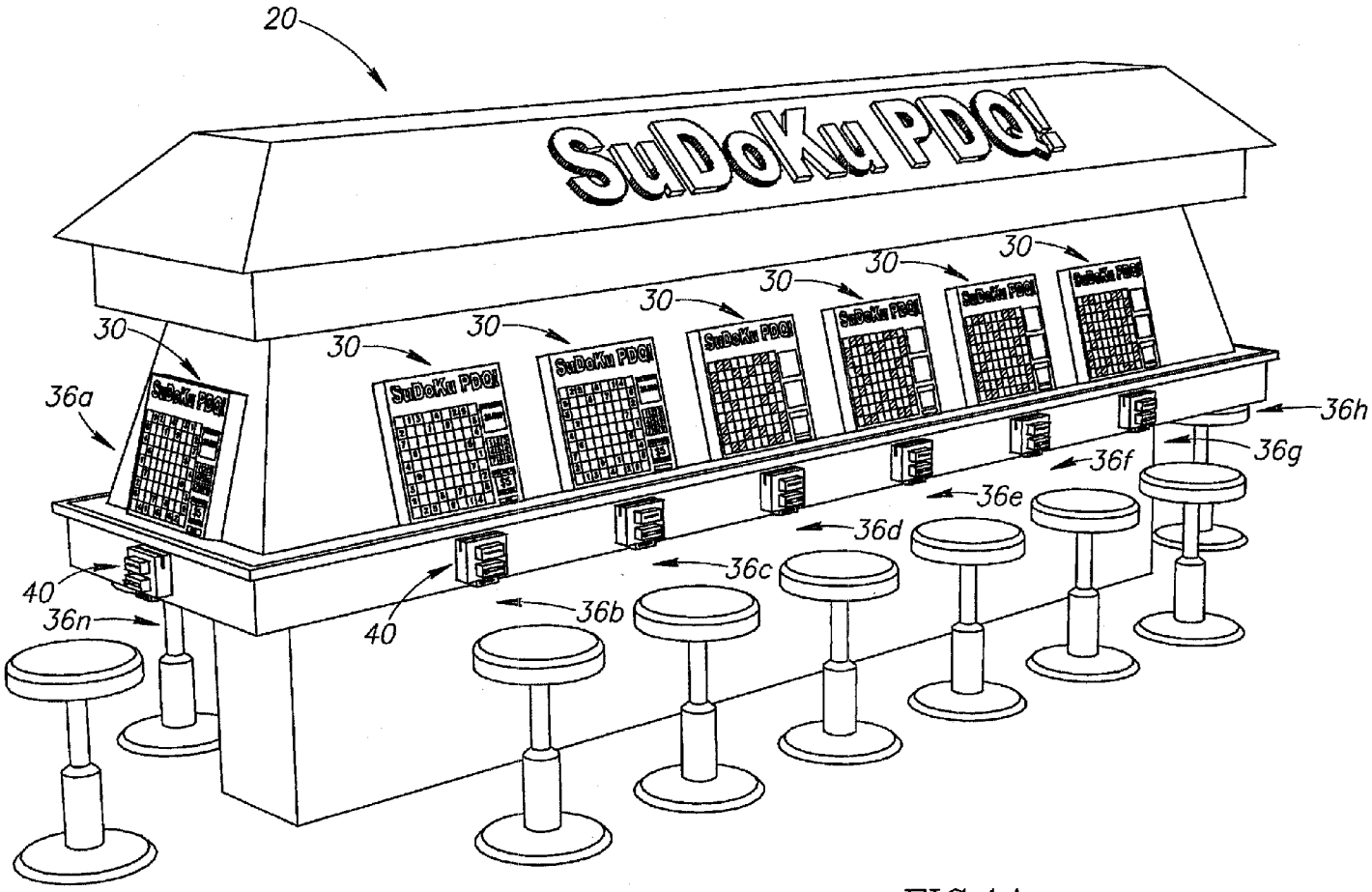
FIG. 1A is a front perspective view of certain embodiments of the present invention as a casino table game.
Figure 1B:
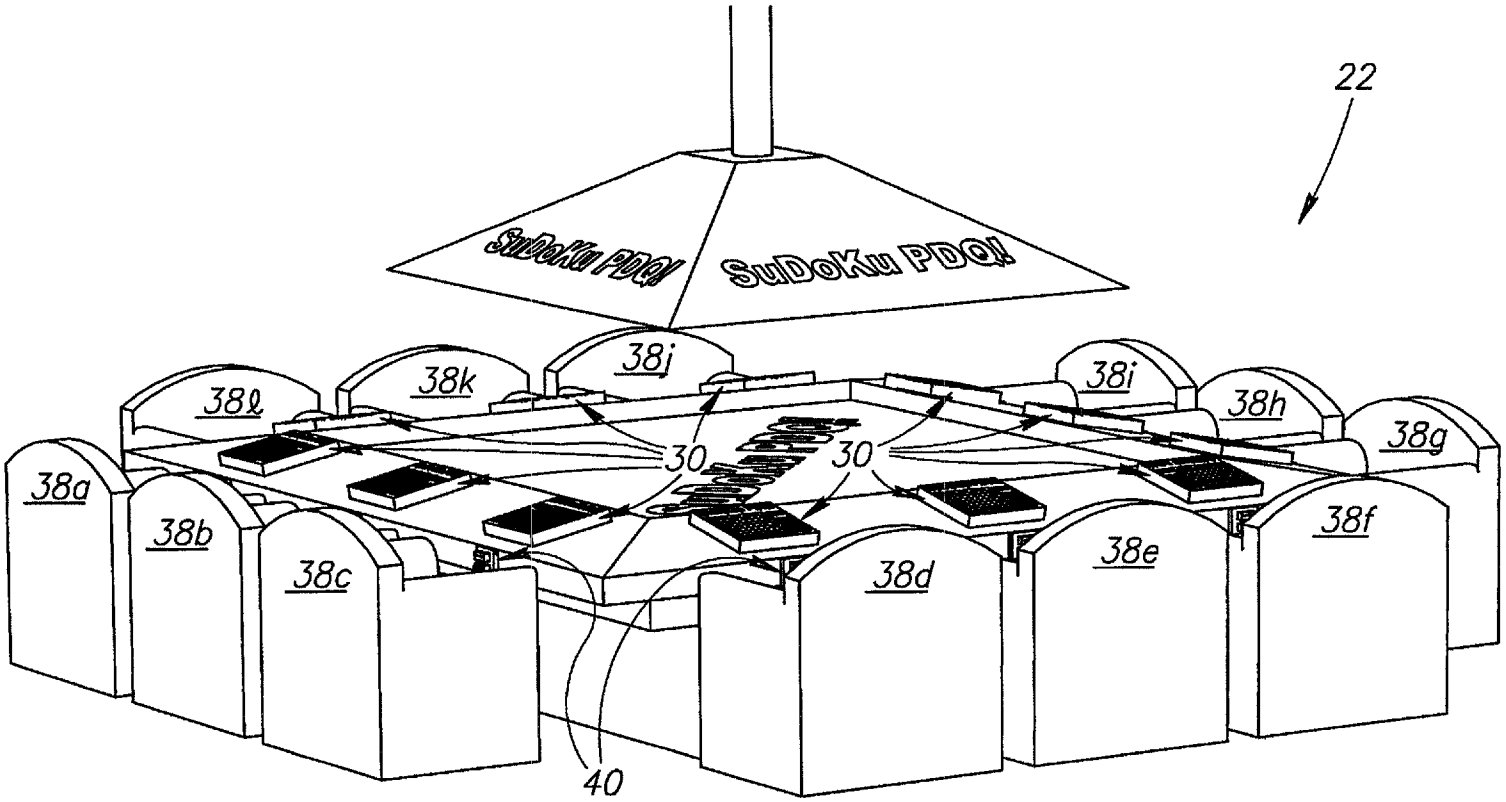
FIG. 1B is a front perspective view of certain embodiments of the present invention as a casino table game.
Figure 1C:
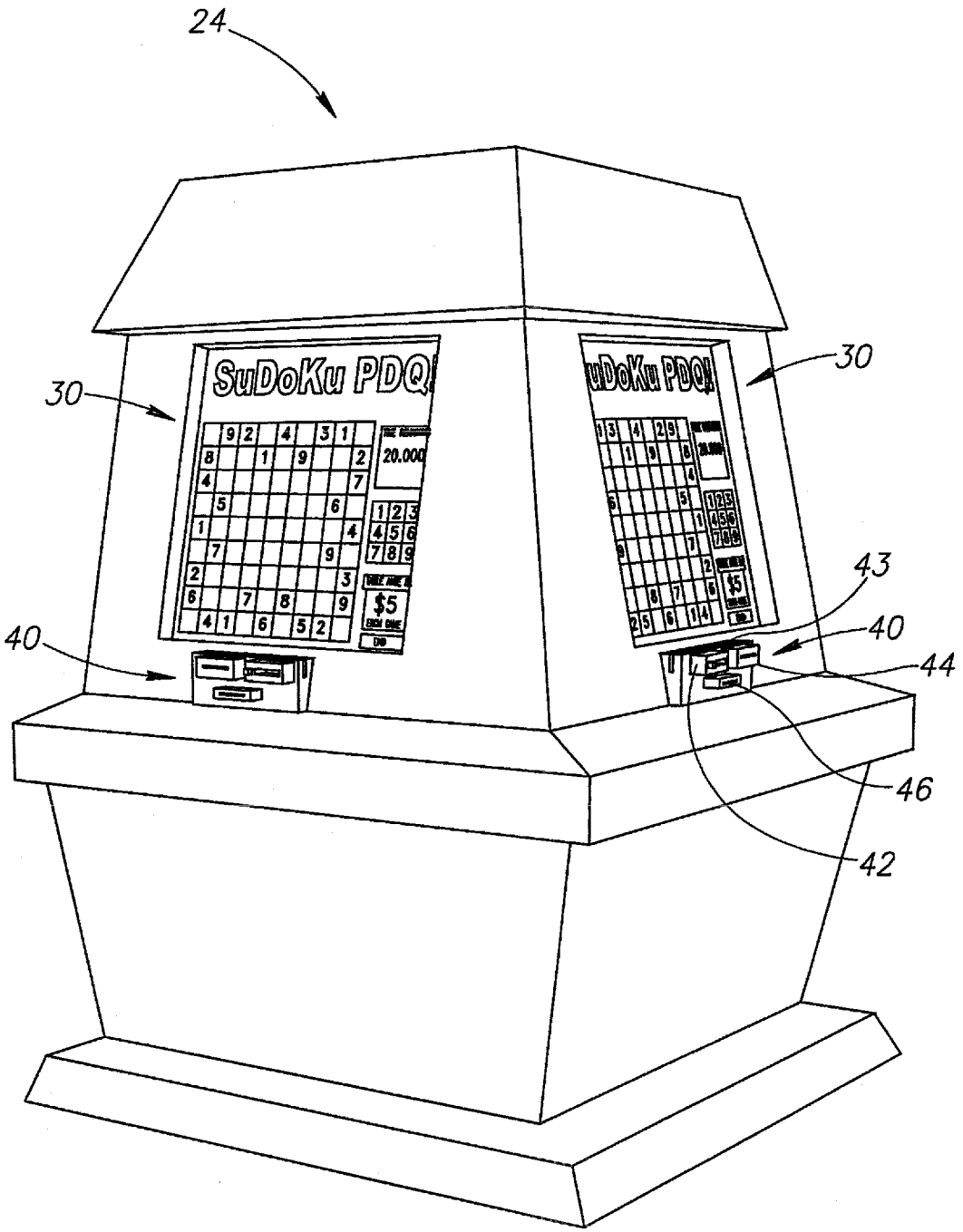
FIG. 1C is a front perspective view of certain embodiments of the present invention as a stand-alone station for casino floor, off-casino floor, or off-casino property use.

In certain embodiments shown in FIGS. 1A and 1B, the game hereof may be played as a table game with tables 20 and 22. Tables 20 and 22 may also be provided as a stand-alone single- or multi-player cabinet unit 24 as shown in FIG. 1C. It will be appreciated by one skilled in the art that any shape of table or cabinet may be used with any embodiment of the present invention so long as it provides suitable access to player for playing the game hereof including, for example, a bar-top, table-top, or slant-top cabinet as are commonly found in casinos. Tables 20, 22 and cabinet station 24 may be manufactured from metal, molded or extruded plastic, plastic composite, wood, ceramic, any other suitable material known in the art, or combination thereof. The material used may be selected based on manufacturer- or user-specific requirements such as manufacturing efficiency, strength, durability, appearance, or environmental considerations. For casino use, it may be desirable to manufacture tables 20, 22 and station 24 with reinforced steel or other rigid materials that are tamper-resistant and designed to discourage theft or vandalism.

The game hereof may also be played via a personal computer, handheld unit, cell phone, the internet or any other electronic configuration suitable for use in the present invention. The present invention may provide for play in physical locations, remote locations, virtually via the internet, or any combination thereof. The same or different embodiments of the game hereof may be played as a stand-alone unit 24 or electronically linked with other units 24 or tables 20 and 22. As used herein, the terms "electronically linked" means electronic and/or data connections are that are wired, wireless, or combinations thereof.

FIG. 1C shows a station 24 that is electronically linked to at least one other station 24, or is electronically linked to the tables 20, 22 of FIGS. 1A and 1B, allowing for play near the table 20, 22 or at remote locations, that may or may not be in the actual casino hall. FIGS. 1A-1C all include screens or monitors 30 (for the tables 20, 22 and stations 24), corresponding to a position for each player.

The station 24 includes at least one monitor 30 and corresponding box 40 for each player, as detailed below, but may include as many as four monitors 30 (one for each side of the station 24) and corresponding boxes 40, depending on the positioning for the station 24. The monitors 30 include touch screens 32 manipulated by the players for playing the game, detailed below. Each monitor defines a position for a single player, at the respective table 20, 22 or station 24. Example positions visible in FIGS. 1A and 1B are represented by numbers 36*a*-36*n* (positions represented by numbers 36*i*-36*m* are not shown, although this table 20 accommodates fourteen players) and 38*a*-38*l*.

Figure 2:
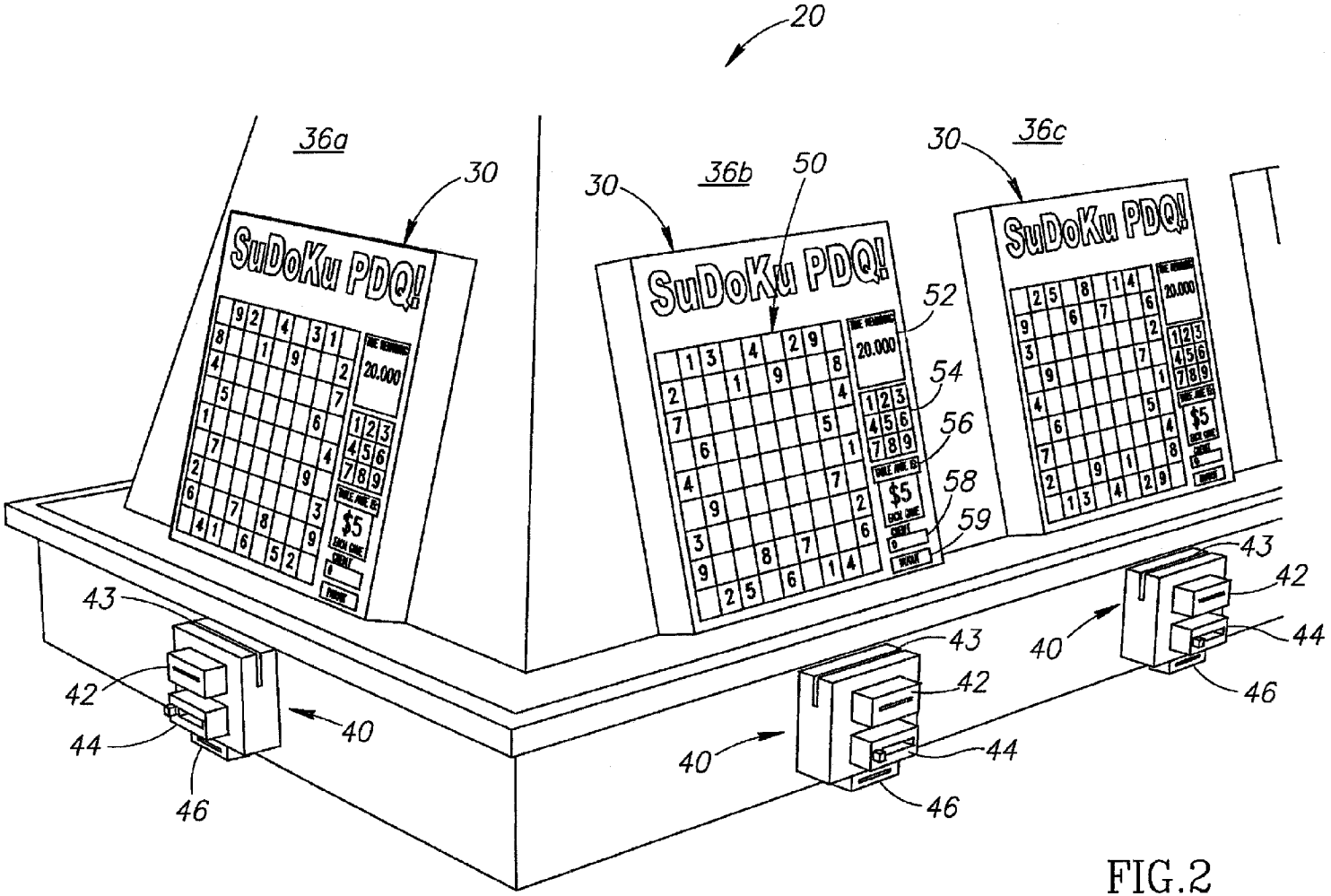
FIG. 2 is a front perspective view of a portion of the table of FIG. 1A showing an exemplary puzzle with versions for each player and boxes for player interaction in accordance with certain embodiments of the present invention.

Each position on the tables 20, 22, and station 24 includes a box 40, as shown in FIG. 2. The box is linked to a central processing unit (CPU) 110 (FIGS. 4A and 4B) for the table 20, 22 and ultimately, the casino or other table controlling entity, as detailed below. The box 40 is configured with a slot 42 for accepting cards, such as player cards, to identify and monitor players, for their identity, security, time of play, casino rewards, etc., as well as accepting credit cards, debit cards and other money cards, in order that the player can pay for his/her games, and also provide player identity and the like. There may also be a swipe slot arrangement 43, for performing the above mentioned card reading and charging functions, described for the slot 42. There is also a slot 44 for accepting paper currency, in order to pay for the game, and a slot 46 for issuing credit slips (printed by a printer (117*a*-117*n* in FIG. 4A) electronically linked to the CPU 110 (FIGS. 4A and 4B), should a player decide to "cash out" and no longer participate in the games.

The tables 20, 22 and stations 24, along with other locations for players (nodes), such as players playing on their television or other monitor offsite, for example, in their hotel rooms, are scaleable. As such, all of these player positions may be electronically linked to a central processing unit (CPU), central computer or the like, as shown, for example in FIGS. 4A and 4B, such that a minimum number of players are ready for a game (and also by all entering the same ante or agreeing to move the ante up or down, but not lower than a minimum ante), for example, at least five players (as detailed above) who have entered or agreed to the same ante, a game will start, regardless of the location of the players, e.g., tables 20, 22, stations 24, hotel rooms or other onsite or offsite locations.

Remaining in FIG. 2, the table 20 with its monitors 30 is representative of the other table 22 and the station 24. Specifically, each player entered into the game will receive a game or round puzzle 50, as shown on each monitor 30, along with a plurality of player—or game-activated boxes that may be used for a plurality of functions including, but not limited to, selecting a game to be played, selecting a wager amount per game, selecting a wager denomination, initiating a game, or cashing out money. The player- or game-activated boxes available on monitor 30 may function as input mechanisms and may include, but are not limited to, mechanical buttons, electromechanical buttons, touch screen buttons, handles, or the like. In certain embodiments, the player- or game-activated boxes hereof may be replaced with other input mechanisms now known or hereafter developed such as a touch pad, mouse, trackball, touch screen system, toggle switches, switches, or other input means suitable for use in the present invention.

More particularly, the player- or game-activated boxes hereof may include, but are not limited to, a box 52 indicating the time to solve the puzzle, a box 54 from which the chosen number is selected, and a box 56 indicating the fee for the game. The box 56 may be controlled to vary the fee (ante) until a minimum number of players have agreed to play at this ante. There is also a box 58 marked "CREDITS" that provides a player with his credits available to him. There is also a "PAY OUT" box 59 that if touched by a player ends the player's participation at that position and in the game, allowing the user to receive their winnings and pay out or "cash out." The "cash out," for example, may be in the form of a receipt generated by the printer (117*a*-117*n*) associated with the player's position at the table 20, 22, station or the like (with content provided from the CPU 110), and received through the slot 46 of the box 40.

The three example positions 36*a*-36*c* at the table 20, from FIG. 1A, each position corresponding to a single player, are representative of each of the multiple positions (one position for each player), as the game is designed. For example, a game may be played by at least five players, to establish a sufficient pot, as detailed above. As can be seen from the monitors 30, each player position, for example, positions 36*a*-36*c*, includes a different arrangement of the same puzzle. Accordingly, all players receive puzzles of equal difficulty, yet the actual grids are different, due to permutation of a master game/round puzzle, selected randomly for each game, specifically, each round of the game. Alternately, two or more players may receive identical puzzles, but they would be spaced apart a predetermined number of positions.

Figure 3A:
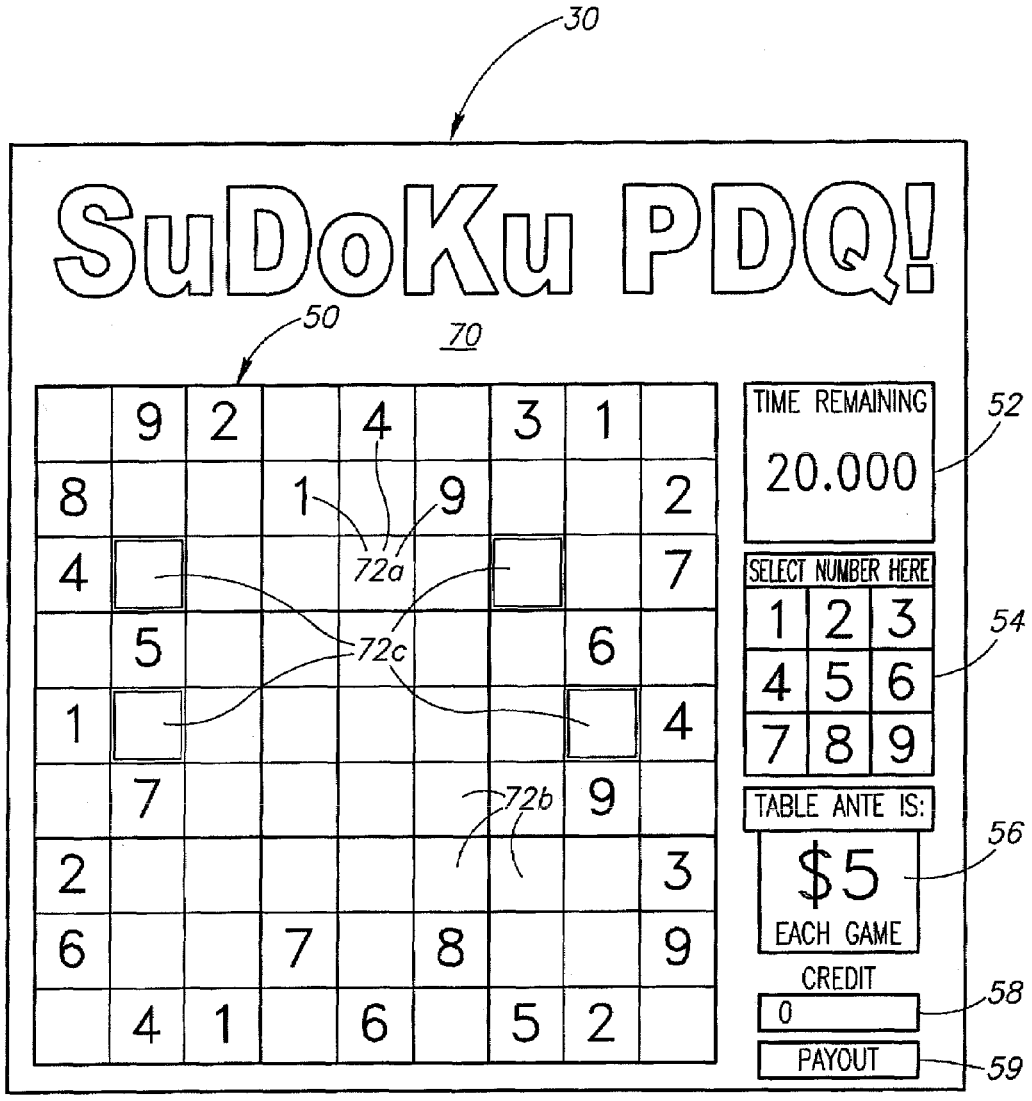
FIG. 3A is a schematic representation of a game screen of an example round being played by a player in accordance with certain embodiments of the present invention.
Figure 3B:
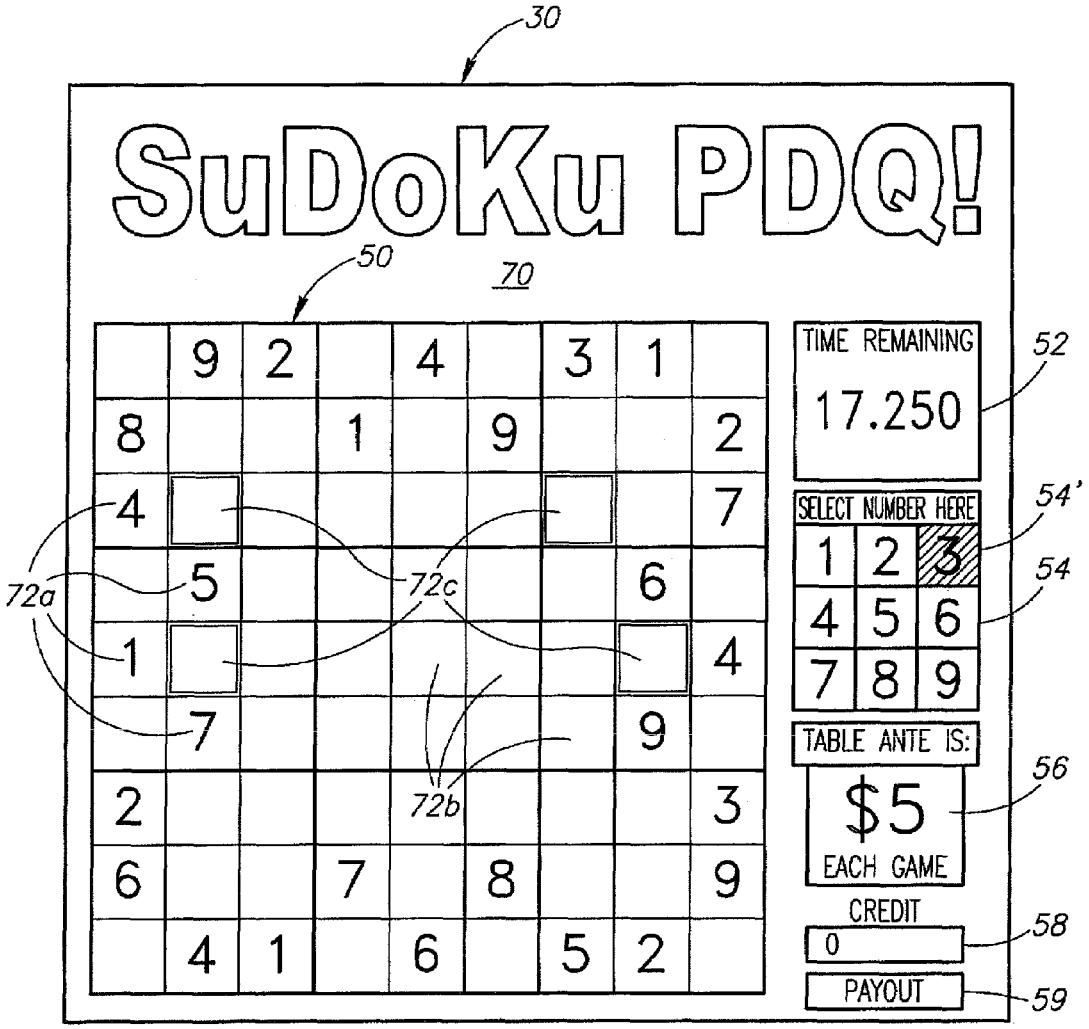
FIG. 3B is a schematic representation of a game screen of an example round being played by a player in accordance with certain embodiments of the present invention.
Figure 3C:
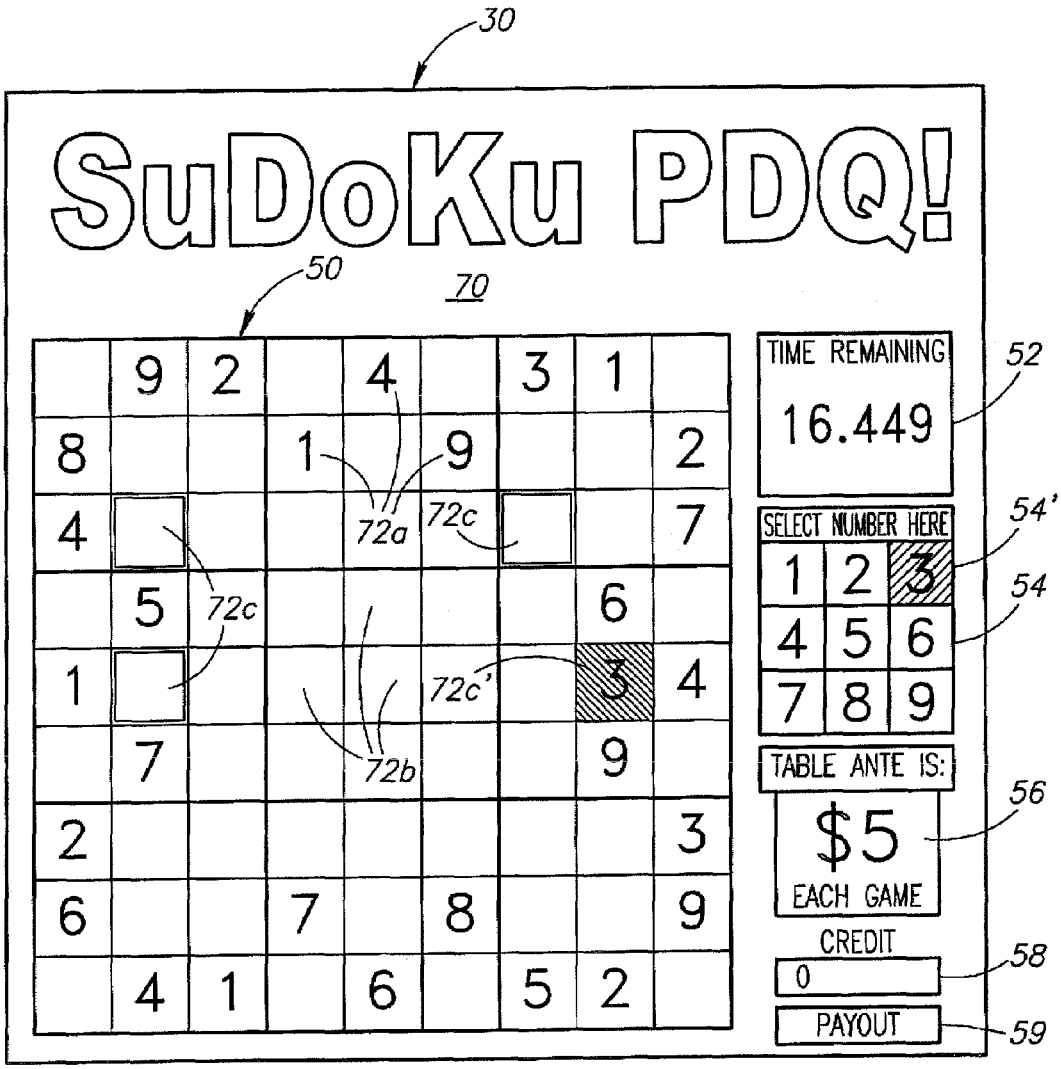
FIG. 3C is a schematic representation of a game screen of an example round being played by a player in accordance with certain embodiments of the present invention.

FIGS. 3A-3C show an exemplary operation of one round of the game. Although a single screen shot 70 (or screen display) is shown on each monitor 30, this screen display 70 is representative of all screen displays 70 on all monitors 30 that will be seen by all players. The description immediately below is applicable for all players who are entered into this particular game.

FIG. 3A shows the initial set up, once a player has entered the game, by entering his ante, or payment for the game (of a predetermined number of rounds), for example, via the corresponding box 40 (credit card, casino credits, cash-through the bill acceptor). Accordingly, assuming this is a new game, for example, the screen display is for Round 1 of this game, the game being 5 rounds in length (although a game need only be one round, with the number of rounds changeable by the casino, system administrator or the like), hence, five puzzles will be randomly selected, one for each round, modified into a format for the game, and permuted accordingly for the number of players in each round, as detailed herein. The screen display 70 shows a puzzle 50, for example, in the form of a sudoku game, with three types of boxes in an exemplary 9×9 box puzzle.

These boxes include completed boxes 72*a*, that have assigned numbers or "givens" for the sudoku game, blank boxes 72*b*, from which numbers of the puzzle have been removed, and input boxes 72*c*, blank boxes that will receive a number from each player as input. Alternately, any one of the blank boxes 72*b* or 72*c* may receive a number, with the boxes 72*c* being highlighted as the easiest boxes to fill in. As another alternate, the boxes 72*c* could be blank like the boxes 72*b*, for more skilled players, for example, at tables of higher minimum antes (like in all other games, all players are at the same ante).

The game operates as a player must input only one number (from the box 54, labeled "SELECT NUMBER HERE") into only one of the input boxes 72*c* (four shown in the puzzle 50), or alternately, the blank 72*b* or input boxes 72, or the blank boxes 72*b* (when input boxes 72*c* are not present and only blank boxes 72*b* are present). Entry of the selected number into the puzzle 50, stops the clock for the round and provides the player with a score, based on time remaining for the round, and the correctness of the entered number.

For example, if a player inputs a correct number in 3.541 seconds, his score for the round is 16.459. If the player inputs an incorrect number into the selected input box 72*c*, the player's score for the round is 0.000. Also, if the player fails to input a number in the allotted time period, for example, 20.000 seconds, this is a "timeout" and the player's score for the round is 0.000. At the end of the five rounds (or the designated number of rounds that constitute a game), the player with this highest score is designated as first place, the player with the second highest score is designated second place and so on. Ties are also accommodated by the system, as detailed below.

These designations allow the pot for each game to be distributed, for example, first place receives 40% of the pot, second place receives 30% of the pot, third place receives 20% of the pot and the house (Casino or game operator) takes the remaining 10%. For example, if eight players play a $5 ante game (of a predetermined number, for example, five, rounds) to pot is $40, with first place receiving $16, second place receiving $12, third place receiving $8, and the house receiving $4.

Alternately, using the same series of designations, should two players be tied for first place, the total of 70% (40% for first place plus 30% for second place) of the pot would be split 35% each, with third place taking 20%. Similarly, a second place tie would result in first place taking 40% while second place splits 50% (30% for second place plus 20% for third place) of 25% each. Similarly, a three way tie for first place would result in each player receiving 30%. Other tie scenarios may also be programmed into the CPU 110 by the system administrator 127.

Initially, the clock at box 52 is set to a predetermined time for a round, for example, 20.000 seconds. The time is preferably in thousands of a second, to avoid ties between players. The number selection box 54, with a grid of selectable numbers, for example, numbers 1-9 for a 9×9 puzzle, is activated, and the table ante of box 56 is visible.

Turning to FIG. 3B a round in progress is shown. The player has selected the number "3" from sub box 54' the number selection box 54. In FIG. 3C the round for the player has ended, as the selected "3" the player has placed into the desired input box 72*c*'. As the player's selected "3" for the requisite input box 72*c*' is correct, and this number was inputted with 16.449 seconds remaining of the 20.000 second time limit, this player's score for this round is 16.449. The game will now continue for as many remaining rounds as desired, with the sudoku puzzles selected, modified for the game, and permuted for each player who has entered an ante for the game.

Figure 4A:
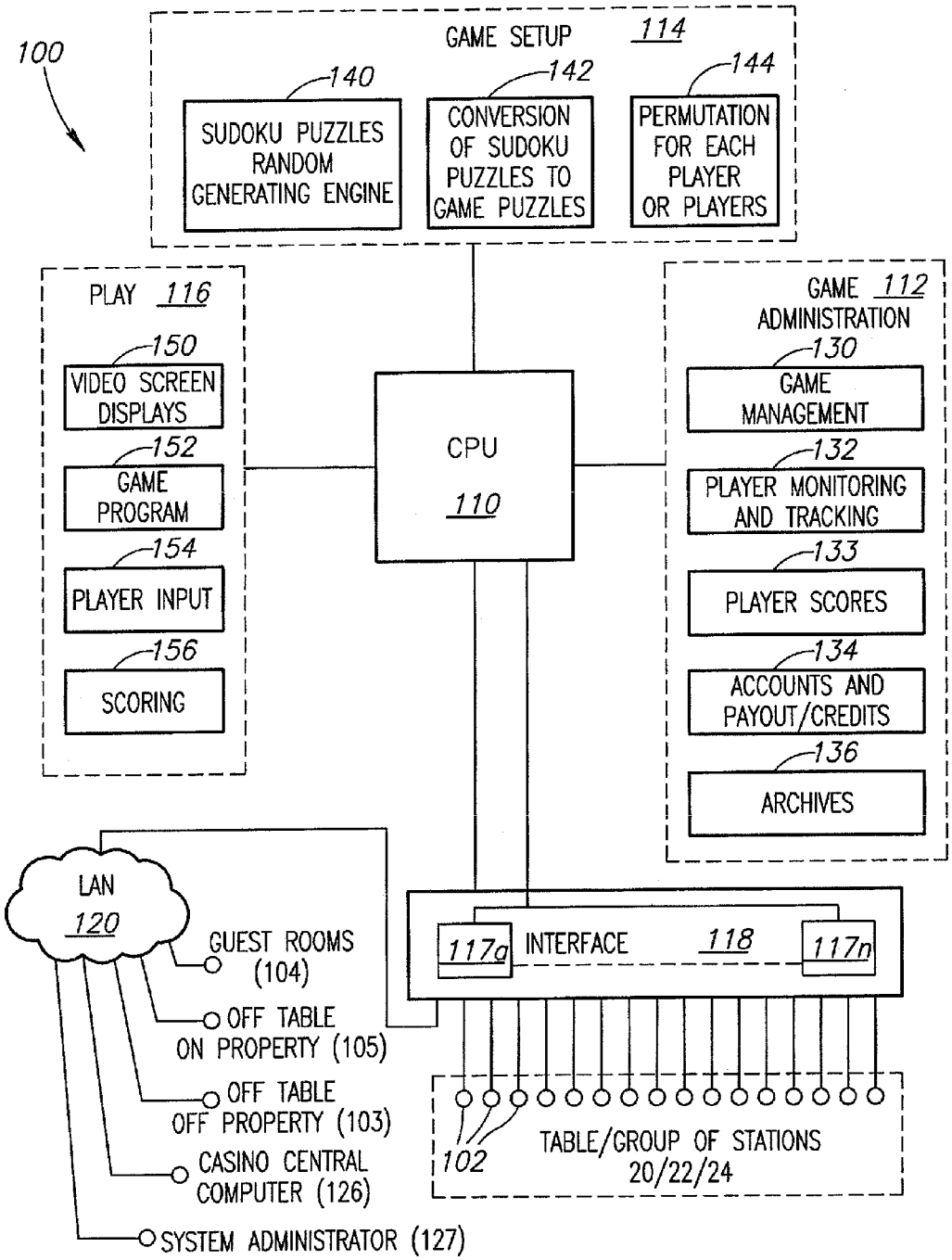
FIG. 4A is a block diagram of the physical and logical components of certain embodiments of the system of the present invention.

FIG. 4A shows a diagram of a system 100 for a single table 20, 22 or group of stations 24 with external locations (for example, nodes) for additional players from numerous outside sources, for example, off site stations, hotel rooms, etc. Each position on the table or player position is represented by a first series of nodes 102, while off site non-table players are represented by nodes 103 for off-table site in casino/hotel, 104 guest rooms in casino/hotel and 105 other off table sites. For example, a station 24 may be an off table site, as it would be placed off of the casino floor, perhaps in another area of the hotel or off the property completely, such as in supermarkets, airport terminals and the like. Similarly, a hotel guest room may use the television, activated by a joystick, track ball, mouse or other controller, with the screen display on the television similar to the screen display 70 on the monitors 30.

In certain embodiments, a queuing system assigning players to individual player positions 36*a-n* or the like is provided. The queuing system may also implement an electronic waiting list if there are no seats available. In one embodiment, one or more devices, such as a personal computer, may be used by employees of a casino or the like to enter the player's name or ID into the queuing system. If a player position 36 is available at tables 20, 22 or station 24, the player may be assigned to that position. However, under certain circumstances, the player may desire to change seats or move to another table. For example, if another player or players have left the table leaving fewer players at the table and the player does not wish to play at a table with that few of players, the player may request another seat assignment. For example, CPU 110 or other game computer may be coupled to tables 20, 22 or station 24 for assigning one of the players to the new seat or player position 36 as one of the other player positions 36 becomes available in response to receiving the request for a new player position 36 from one of the players. The CPU 110 includes software having various pre-determined time limits for the player to elect the new player position 36 once it becomes available and, upon selection, the player may then be assigned to the new player position 36. For example, turning to FIG. 1A, a player at player position 36*b* may request via screen display 70 or other area on monitor 30 to move to a different player position such as player position 36*f*. Once player position 36*f* becomes available, the player may then be reassigned from position 36*b* to position 36*f* and maintain all of the player's game play information via CPU 110.

In other embodiments of the present invention, CPU 110 includes a random number generator or RNG. At the beginning of each game, each round of the game, or any other desired interval, the RNG is used to shuffle the order of the players' virtual seat assignments or player positions 36 and then is used to determine seat order thereby providing for a dynamic seat allocation process that allows seating assignments (whether physical or virtual) to remain flexible right up until the beginning of game play. The dynamic seat allocation process generates a proposed seating arrangement around a table. For example, in an online virtual game, a single virtual table may include, for example, from one to ten player positions. The proposed seating arrangement may include the reassignment of previously requested seat assignments. The proposed seating arrangement may also include predetermined parameters such as player skill level, wager amount per game, wager denomination, rate of play, and the like. These parameters may be used, for example, to limit players of a particular skill level to a certain table so as to prevent a highly skilled player from being assigned to a table made up of beginners. In this embodiment, an ensemble of algorithms is provided and used to determine the skill level of a particular player and then assign a skill level number to that player. The dynamic seat allocation process is then configured to assign players having a particular skill level number or numbers to a particular table whether physical or virtual. Player seating assignments may also be based upon desired wager amounts such as providing a $5.00 table to certain players and a $50.00 table to other players based upon the player's preferences or rate of play.

Turning now to the gaming system and method of the present invention as shown in FIGS. 4-5, when the system and method hereof is implemented primarily in software it should be noted that the gaming system and seat allocation process hereof can be stored on any computer-readable medium for use by or in connection with any computer-related system or method. As used herein, a computer-readable medium is an electronic, magnetic, optical, or other physical device or means that can contain or store a computer program for use by or in connection with a computer related system or method. The gaming system and dynamic seat allocation methods hereof can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer-readable medium can be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The hardware components of the system and method for the Sudoku-based game and dynamic seat allocation process hereof can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

More particularly, the gaming system 100 of the present invention includes a central processing unit (CPU) 110, including one or more processors, microprocessors or the like, that are programmable to set up and administer the game detailed above. The CPU 110 is electronically linked to sub systems that administer the games 112, set up the game and the individual rounds 114, and administer play of each round of the actual game 116. The CPU 110 is also electronically linked to printers 117*a*-117*n* for each box 40, and is linked to an interface module 118, for interacting with players at the table, represented by nodes 102. The aforementioned system of electronic links allows all elements of the system 100 to interact with all other elements of the system 100, even though direct links may not be specifically shown.

The CPU 110 and interface module 118 are also electronically linked to a local area network (LAN) 120, for example, a private network, through which off table site or off casino floor, property, or hall players, represented by nodes 103-105, access the table 20, 22, to participate in the game. The casino or system central computer 126 may also reside on this LAN 120. A node representative of a system administrator 127 may be on the LAN 120, allowing for programming or reprogramming, or other monitoring of the system 100 when desired. Alternately, the CPU 110 could be directly electronically linked to the central computer 126. The interface module 118 is linked to the boxes 40 that receive credit, debit, money, play credit and identity cards, and paper money, and distribute payout receipts as detailed above.

The administration subsystem 112 includes modules for game management 130, for example, changing antes until accepted by the minimum number of players, associating players with their antes and running individual games of predetermined numbers of rounds, player monitoring and tracking 132, player scoring 133, and accounting and payouts/credits 134. There is also a module for archives 136, storing past games and round scores, and results associated therewith, as well as player participation histories and player account records. Other modules may also be present for performing functions associated with administration of the games.

The game set up subsystem 114 includes a random sudoku generating engine 140, a modifying module 142, for modifying or converting the sudoku puzzle generated by the engine 140 for the requisite round of the game to a puzzle specifically for the game (i.e., the particular round of the game), and a permuting module 144. The random sudoku generating engine 140 randomly generates a sudoku puzzle, such as a 9×9 grid. It is also programmable to generate variations, such as 6×6 grids, 12×12 grids, 16×16 grids, 25×25 grids, hyper-Sudoku grids, or any other format suitable for use in the present invention. For the 9×9 grid, there are 6,670,903,752, 021,072,936,960 possible distinct sudoku puzzles, all possible to be randomly generated by the engine 140. The permuting module 144, takes the modified puzzle, modified by the modifying module 142, and permutes it, so that each player receives a different modified puzzle that is of the same algorithmic level of difficulty. This permutation step eliminates cheating by players, looking off of another player's puzzle or collusion among two or more players. Other modules may also be present for performing functions associated with set-up of the games.

The play subsystem 116 includes a module 150 for controlling the video display, outputting the puzzles for each round and touch screens, an engine 152 for running the game and each of the individual rounds, a module 154 for receiving input from players and determining if the input is correct, and a module 156 for scoring each round and each game.

Figure 4B:
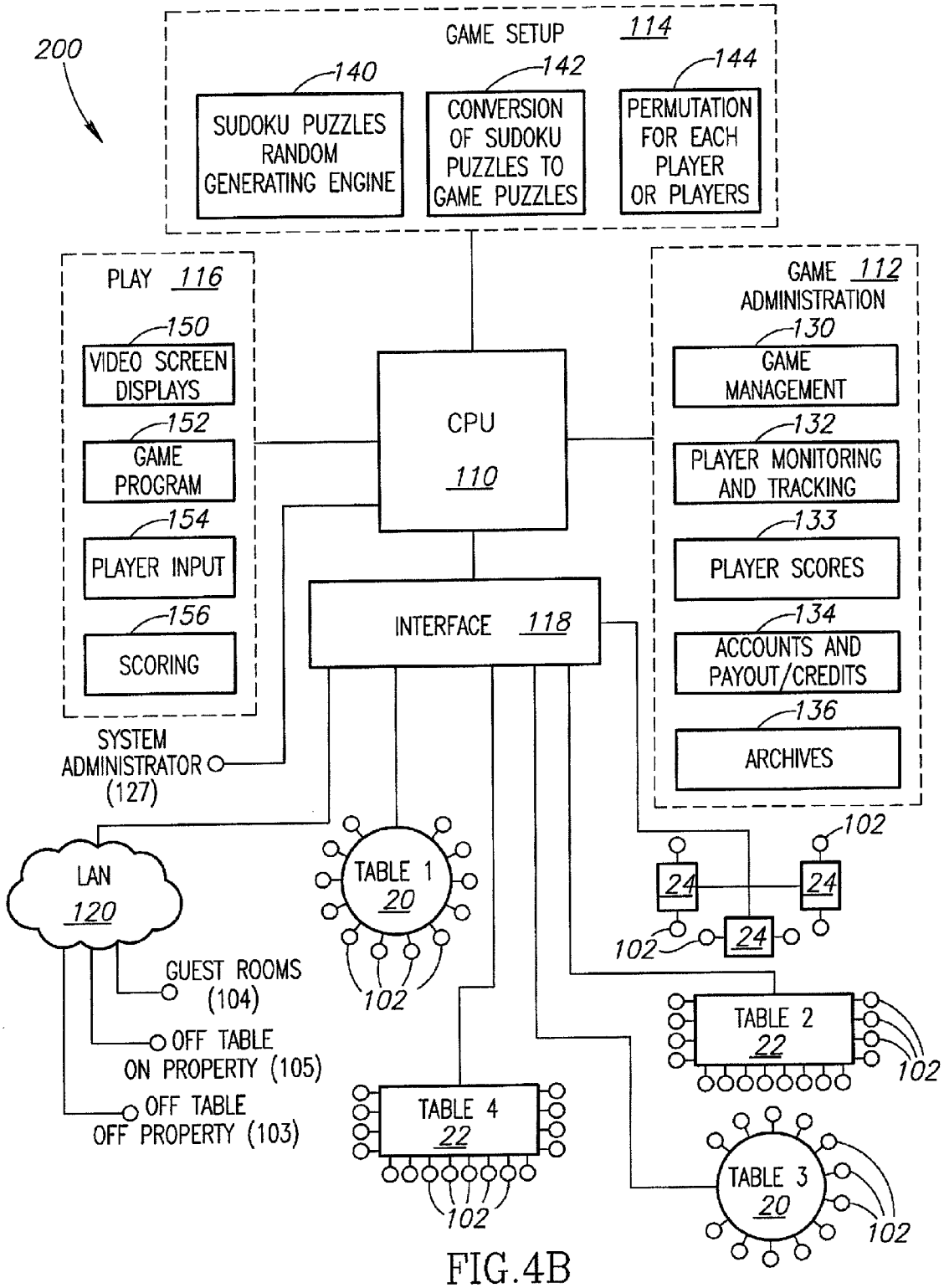
FIG. 4B is a block diagram of the physical and logical components of certain embodiments of the system of the present invention.

FIG. 4B shows the scalability of the game, showing a system 200 with a central computer 202 that controls all games at all tables and all off table sites. The subsystems and modules are the same as those for FIG. 4A above, and are numbered the same, and are as described above. The interface module 118, performs additional functions, as it is electronically linked to tables 20, 22 and stations 24. Accordingly, when any number of nodes are occupied, that corresponds to the minimum number of players necessary for a game, a game can begin regardless of the locations of the players. Players from different tables, stations and other off-table locations can constitute the participants in a game.

Figure 5A:
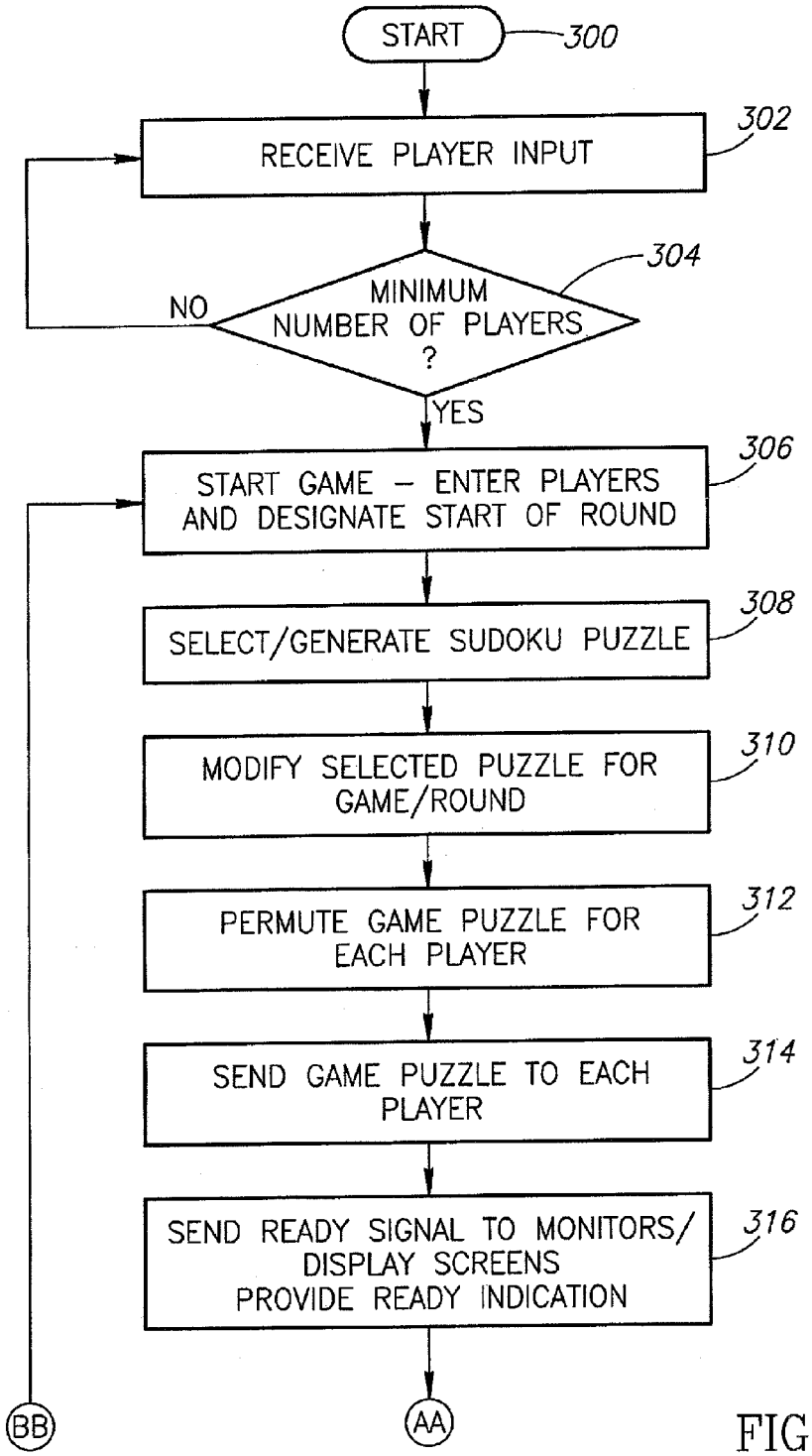
FIG. 5A is a flow diagram of a process performed by the systems of FIGS. 4A and 4B in accordance with certain embodiments of the present invention.
Figure 5B:
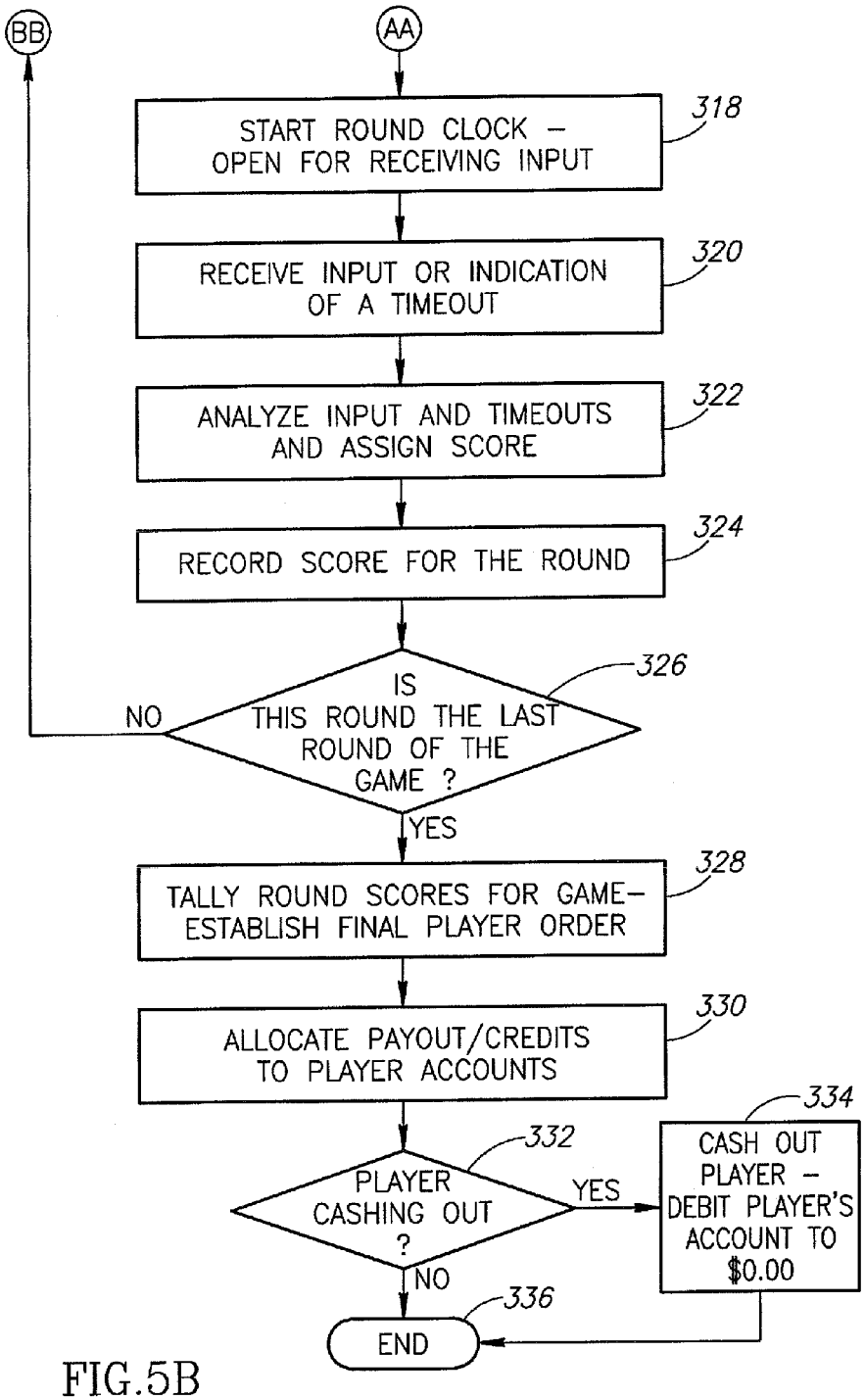
FIG. 5B is a flow diagram of a process performed by the systems of FIGS. 4A and 4B in accordance with certain embodiments of the present invention.

FIGS. 5A and 5B are a flow diagram of the processes performed by the systems 100, 200 of FIGS. 4A and 4B, respectively. The process starts at block 300 and moves to block 302, as input is received from players, in the game management module 130, such as their player card, credit card, casino credit card or the like, being read, and/or their money or casino credit for their ante is registered, to indicate that they will participate in the game. At block 304, it is determined if there are the minimum number of players for a game. This could be at a single table, as per the system 100 (including off table site players linked to the particular table), or a combination of players at various tables, stations and off table sites, as per the system 200. For example, the minimum number of players may be five, but this can be changed as desired by the system administrator 127. If the minimum number of players has not been reached, the process returns to block 302.

With the minimum number of players met (the minimum number of players programmed into the system 100, 200), the game starts at block 304, as players are registered in the system 100, 200 and their antes confirmed. A designated round of the game (for example, one game is five 20 second rounds) is started, at block 306. A sudoku grid for the round is randomly generated by the sudoku generating engine 140, at block 308. The generated grid is then altered for this game, in particular for this round of the game at block 310, and then permuted for each player, at block 312, to be the same level of algorithmic difficulty. The game program 152 then sends a puzzle to each player as part of a graphic, for example, the screen shot 70, to the monitor 30 (television screen for the player playing in his hotel room) of each player, at block 314. The game program 152 then sends a signal that translates to a visual or audible "ready" signal that the round will start, to each player, at block 316. This "ready" signal, for example, is a ten second warning that the 20 second clock will activate and the round will officially begin. With the waiting period, over, the game program starts to 20 second clock and the system 100, 200 is open to receive player input at block 318.

The system then receives player input as a number was placed into the requisite input box 72*c* (FIGS. 3A-3C), or a timeout, the 20.000 second period lapsing without input being received from the player, at block 320. The input is analyzed for correctness and each player is given a score for the round, by the game program, at block 322 and the score is recorded and stored in the scoring module 133, at block 324. It is then determined if this is the last round of the number of rounds that define a game, at block 326. If not, the process returns to block 306.

If this was the last round of the game, at block 326, the process moves to block 328, where the scores for each player for each round are tallied. The tallying is, for example, for first, second and third place, in order to take corresponding percentages of the pot, the total amount of the antes paid by each player to enter the game. Within this block, any ties are determined and pots are redistributed based on these ties.

Payouts or credits for the game are then allocated to the requisite players (the accounts of each player), at block 330. The allocations are stored in the accounting module 134. It is then determined if any requests for "pay outs" or "cash outs" have been made, at block 332 (as the CPU 110 receives a signal from a player touching the "pay out" button 59). If yes, each requesting player is cashed out and his account in the module 134 is debited to $0.00 at block 334. The process then moves to block 336, where it ends. If cash out requests are not received, the process moves to block 336, where the game ends. A new game may begin, beginning at block 302. For example, the time for this process is such that a new game can be played every three minutes, including time allotments for post round tallying and cashing out.

The above-described processes including portions thereof can be performed by software, hardware and combinations thereof. These processes and portions thereof can be performed by computers, computer-type devices, workstations, processors, micro-processors, other electronic searching tools and memory and other storage-type devices associated therewith. The processes and portions thereof can also be embodied in programmable storage devices, for example, compact discs (CDs) or other discs including magnetic, optical, etc., readable by a machine or the like, or other computer usable storage media, including magnetic, optical, or semiconductor storage, or other source of electronic signals.

The processes (methods) and systems, including components thereof, herein have been described with exemplary reference to specific hardware and software. The processes (methods) have been described as exemplary, whereby specific steps and their order can be omitted and/or changed by persons of ordinary skill in the art to reduce these embodiments to practice without undue experimentation. The processes (methods) and systems have been described in a manner sufficient to enable persons of ordinary skill in the art to readily adapt other hardware and software as may be needed to reduce any of the embodiments to practice without undue experimentation and using conventional techniques.

While preferred embodiments of the disclosed subject matter have been described, so as to enable one of skill in the art to practice the disclosed subject matter, the preceding description is intended to be exemplary only. It should not be used to limit the scope of the disclosed subject matter, which should be determined by reference to the following claims.

What is claimed is:

1. A non-transitory computer readable storage medium having stored thereon a computer program for administering a wagering game for a plurality of players, said computer program comprising a set of instructions for administering said wagering game comprising the steps of:

receiving, via an acceptor on a gaming machine and from a player of the plurality of players, a physical item that enables said player to pay for said wagering game at said gaming machine;

updating an account balance of said player based on said physical item that enables said player to pay for said wagering game;

receiving, from said player, a wager to play said wagering game;

reducing, based on said wager, said account balance of said player;

randomly generating a primary puzzle, wherein the primary puzzle includes a plurality of displayed indicia on a grid such that no two indicia are the same in at least one of a row, a column, or a diagonal of the grid;

permuting the primary puzzle for each player of the plurality of players to thereby generate a respective different permuted puzzle for each respective player of the plurality of players, wherein each of the respective different permuted puzzles is the same in difficulty level to each other of said respective different permuted puzzle;

administering said wagering game wherein each respective player of the plurality of players plays the respective different permuted puzzle in competition against each other player of the plurality of players, and wherein each respective different permuted puzzle designates one blank position identified out of a plurality of blank positions to be filled in by the respective player;

further updating the account balance of said player based on a result of said wagering game; and providing, to said player, an output indicating a value that is based on the account balance.

2. The non-transitory computer readable storage medium of claim 1 wherein the wagering game is a game of skill and speed, and wherein scoring is determined based on time remaining in an allotted time period after selecting a number to fill in the one blank position.

3. The non-transitory computer readable storage medium of claim 1 further comprising providing player information for identification and monitoring of each said player of the plurality of players.

4. The non-transitory computer readable storage medium of claim 1, further comprising paying an award as a result of a placement of a number in the one blank position.

5. The non-transitory computer readable storage medium of claim 4 wherein said award is based on an average of a plurality of player wagers.

6. The non-transitory computer readable storage medium of claim 1 wherein each said player of the plurality of players plays the wagering game using a separate touch screen to enter inputs that are communicated over the internet.

7. The non-transitory computer readable storage medium of claim 1 further comprising assigning the player from the plurality of players to a table with other players from the plurality of players having a similar predetermined parameter selected from the group consisting of player skill level, wager amount per game, wager denomination, and rate of play.

8. The non-transitory computer readable storage medium of claim 1 further comprising the step of providing a wagering station for each player of the plurality of players.

9. A system for administering a wagering game for a plurality of players comprising:

a gaming machine, wherein said gaming machine comprises an acceptor for receiving, from a player of the plurality of players, a physical item that enables said player to pay for said wagering game at said gaming machine, wherein said gaming machine updates an account balance of said player based on said receipt of said physical item that enables said player to pay for said wagering game at said gaming machine, wherein said gaming machine receives, from said player, a wager to play said wagering game; and wherein, based on said wager, said gaming machine reduces said account balance of said player;

at least one processor, wherein said at least one processor:

randomly generates a primary puzzle, wherein the primary puzzle includes a plurality of displayed indicia on a grid such that no two indicia are the same in at least one of a row, a column, or a diagonal of the grid;

permutes the primary puzzle for each player of the plurality of players to thereby generate a respective different permuted puzzle for each respective player of the plurality of players, wherein each of said respective different permuted puzzles is the same in difficulty level to each other of said respective different permuted puzzle;

administers the wagering game wherein each respective player of the plurality of players plays the respective different permuted puzzle, and wherein each respective different permuted puzzle includes one or more designated blank positions out of a plurality of blank positions in the grid of the respective player's respective different permuted puzzle, wherein the one or more designated blank positions are identified to be filled in with an answer indicia selected by the respective player;

wherein said system enables further updating the account balance of said player based on said play of said wagering game; and wherein said system further enables providing, to said player, an output indicating a value that is based on the account balance.

10. The system of claim 9 wherein the wagering game is a game of skill and speed, and wherein scoring is determined based upon time remaining in an allotted time period after selecting the answer indicia to fill in the one or more designated blank positions.

11. The system of claim 9, wherein said system further enables paying an award associated with placement of said answer indicia in each of said one or more designated blank positions.

12. The system of claim 11 wherein said award is based on an average of a plurality of player wagers.

13. The system of claim 11, wherein said system further determines a skill level of a particular player of the plurality of players and assigns a skill level number to said particular player.

14. The system of claim 13, wherein said system further assigns the player from the plurality of players to a table with other players of the plurality of players having a predetermined parameter selected from the group consisting of player skill level, wager amount per game, wager denomination, and rate of play.

* * * * *